US007111923B2

(12) United States Patent
Kulpa

(10) Patent No.: US 7,111,923 B2
(45) Date of Patent: Sep. 26, 2006

(54) INKJET PRINTING SYSTEM FOR CONTAINMENT AND EVAPORATION OF WASTE INK

(75) Inventor: Walter J. Kulpa, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 229 days.

(21) Appl. No.: 10/737,282

(22) Filed: Dec. 16, 2003

(65) Prior Publication Data

US 2005/0128241 A1 Jun. 16, 2005

(51) Int. Cl.
*B41J 2/165* (2006.01)

(52) U.S. Cl. ..... 347/36; 347/31; 347/35

(58) Field of Classification Search ..... 347/22, 347/29–35

See application file for complete search history.

(56) References Cited

U.S. PATENT DOCUMENTS 5,984,450 A * 11/1999 Becker et al. ..... 347/24
6,267,465 B1 * 7/2001 Sawicki ..... 347/36
6,390,577 B1 5/2002 Fajour ..... 347/2

FOREIGN PATENT DOCUMENTS

| | | | |
|---|---|---|---|
| EP | 0 323 262 A | | 7/1989 |
| EP | 1 057 644 | | 12/2000 |
| EP | 0 364 284 A | | 5/2002 |
| JP | 411001005 A | * | 1/1999 |

* cited by examiner

*Primary Examiner*—Shih-Wen Hsieh
(74) *Attorney, Agent, or Firm*—Martin F. Noonan; George M. Macdonald; Angelo N. Chaclas

(57) ABSTRACT

A postage meter includes a print head, a purge unit for removing waste ink from the print head, and an ink tray assembly for receiving the waste ink. The ink tray assembly includes a tray and a vapor-permeable, liquid-impermeable cover membrane across the opening of the tray.

19 Claims, 5 Drawing Sheets

INKJET PRINTING SYSTEM FOR CONTAINMENT AND EVAPORATION OF WASTE INK

BACKGROUND

This invention relates generally to the field of postage meters and is more particularly concerned with handling of waste ink in postage meters.

Postage meters that employ an ink jet printing unit are in widespread use. To maintain printing quality it may be necessary to purge dried or partially dried ink and/or air bubbles from the printing unit. For that reason, it is known to include an ink purge unit in a postage meter that employs ink jet printing. At selected times, the purge unit is engaged with the ink jet printing unit to remove waste ink from the ink jet printing unit. The waste ink is deposited in an absorbent pad.

In the United States, postal regulations require that postage meters be rented, not sold, to aid in maintaining the security of postal funds. It is not unusual for postage meters to come off rental after use by a postal patron for a period of time. The postage meters may then be returned to the manufacturer/owner of the meters for refurbishment, if needed. The returned meters may then be rented to other postal patrons.

During shipment or handling of postage meters to return the meters to the manufacturer/owner, it may occur that the meters may be tipped over, or carried on their sides or upside down. When this occurs, waste ink may drip out of the absorbent pad to foul parts of the postage meter. In some cases the damage to operating parts of the meter, or disfigurement of the appearance of the postage meter, may be so great that it is not cost effective to refurbish and re-rent the postage meter. In these cases the postage meter may need to be scrapped, leading to an increase in over-all cost to the meter manufacturer/owner.

SUMMARY

Accordingly, a system is provided to prevent fouling of postage meters from waste ink.

In one aspect, a postage meter includes a print head, a purge unit for removing ink from the print head, and an ink tray assembly for receiving ink removed from the print head by the purge unit. The ink tray assembly includes a tray having an opening, and a cover membrane across the opening of the tray.

The ink tray assembly may also include an absorbent pad held in the tray under the cover membrane. There may be a hole in the cover membrane for sealing to a port of the purge unit. The absorbent pad may have a channel positioned in alignment with the hole in the cover membrane. The tray may include a post that extends upwardly from a floor of the tray and that is engaged by the channel in the absorbent pad.

The cover membrane may be formed of a material that is adapted to allow vapor to pass through the material and to substantially prevent waste ink from passing through the material. The material may include at least one of polypropylene and polyethylene. The cover membrane may be formed at least in part as a bellows.

In another aspect, a postage meter includes a print head, a purge unit for removing ink from the print head, and an ink tray assembly for receiving ink removed from the print head by the purge unit, and the ink tray assembly includes a tray and a barrier mechanism that is bonded to a rim of the tray and that is for substantially preventing waste ink from exiting the tray upon tipping of the tray.

In still another aspect, a waste ink tray assembly for use in a postage meter includes a tray, an absorbent pad held in the tray, and a barrier mechanism that is bonded to a rim of the tray and that is for substantially preventing waste ink from exiting the tray upon tipping of the tray.

By providing a barrier or membrane on the ink tray that is substantially liquid-impervious but allows vapor to escape from the tray, the capacity of the ink tray to hold waste ink may be essentially unimpaired, while the barrier or membrane may generally prevent ink from spilling from the tray during shipment or handling of the postage meter. As a result, damage and/or befoulment of the meter by waste ink may be reduced or eliminated and the useful life of the meter may be extended.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the postage meter of the present invention, a waste ink tray is covered with a membrane to prevent spillage of ink from the tray during shipment or handling of the postage meter. The membrane may be vapor-permeable to allow evaporation of the ink held in the tray so that the tray's holding capacity is not compromised.

Figure 1:
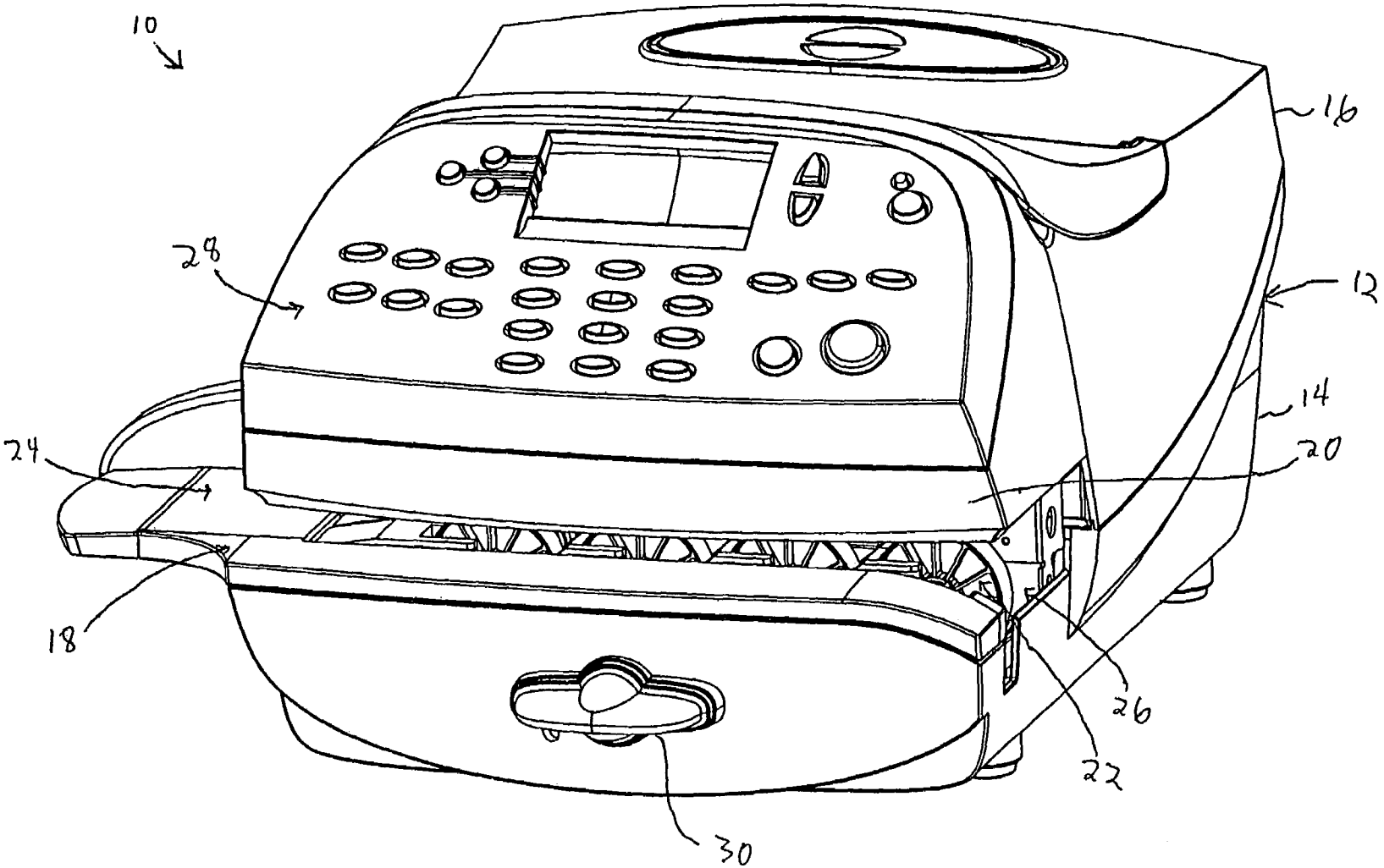
FIG. 1 is an isometric view of a postage meter in accordance with the invention.

Referring now to the drawings, and particularly to FIG. 1, the reference numeral 10 generally indicates a postage meter provided in accordance with the invention.

The postage meter 10 includes a housing 12 formed of a lower case section 14 and an upper case section 16. A slot 18 formed in the front 20 of the housing 12 allows a mail piece (not shown) to be transported through the postage meter 10. The postage meter 10 also includes a transport unit 22 (partially visible through the slot 18) positioned at the slot 18 to transport the mail piece from an infeed side 24 of the slot 18 to an outfeed side 26 of the slot 18. The postage meter 10 further includes a user interface 28 at the front 20 of the housing 12, and a lever 30 positioned below the slot 18 to aid in clearing jams from the transport unit 22.

Figure 2:
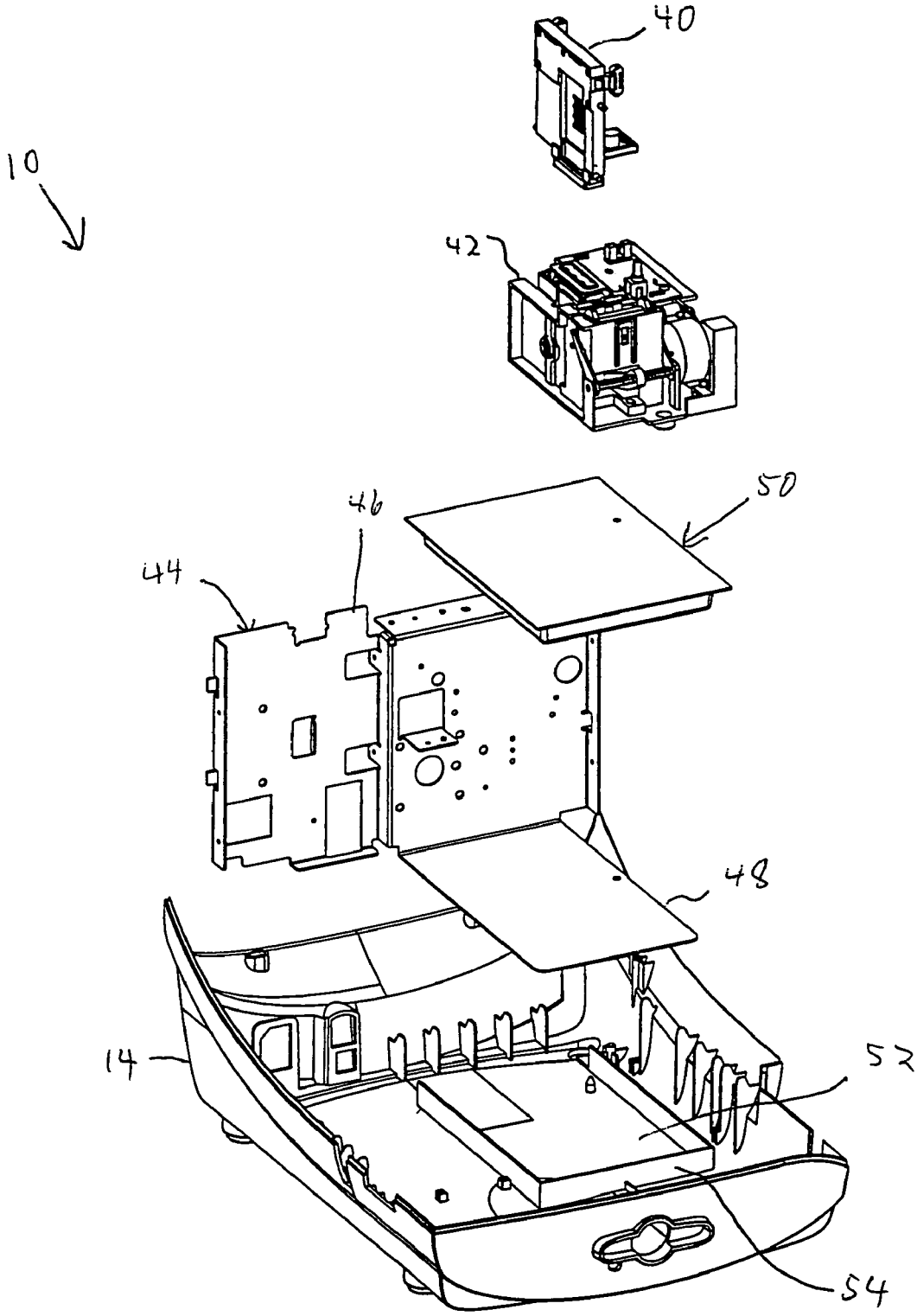
FIG. 2 is an exploded view showing some of the internal components of the postage meter of FIG. 1.

FIG. 2 is an exploded view showing some of the internal components of the postage meter 10. As seen from FIG. 2, the postage meter 10 includes an ink jet print head 40. In accordance with conventional practices, the transport unit 22 (FIG. 1) may operate to transport a mail piece (not shown) past the print head 40 so that the print head 40 may print a postage indicia on the mail piece.

The postage meter 10 also includes a waste ink purge unit 42. At appropriate times, the purge unit 42 may come into engagement with the print head 40 to remove excess ink, dried or partially dried ink and/or air bubbles from the print head 40. By a mechanism which is not shown, the print head 40 may be moveable in fore-and-aft directions between a print position adjacent the front of the meter 10 and a purge position that is aft of the print position. When in the print position, the print head 40 may operate to print postage indicia on mail pieces. When in the purge position, the print head 40 may be purged of waste ink by the purge unit 42.

The postage meter 10 may further include a metal chassis 44. The metal chassis 44 may include a vertical section 46 to which certain components (not shown) of the postage meter 10 may be mounted. The metal chassis 44 may also include a horizontal metal plate 48 which may be integrally formed with at least part of the vertical section 46 of the metal chassis. The metal plate 48 extends horizontally outwardly from the metal chassis 44 in a forward direction.

Also included in the postage meter 10 is a waste ink tray assembly 50. When the postage meter 10 is in an assembled condition (not shown), the metal chassis 44 may rest on the bottom 52 of the lower case section 14 of the housing 12. More specifically, the plate 48 may be positioned within a box frame 54 that is integrally formed with the lower case section 14 and that extends upwardly from the bottom 52 of the lower case section 14. When the postage meter 10 is in its assembled condition, the waste ink tray assembly 50 may be supported by and may rest on the metal plate 48. Moreover, the waste ink tray assembly 50 may be held within the box frame 54. The box frame 54 may help to assure that the waste ink tray assembly is properly positioned relative to the purge unit 42, and may prevent the waste ink tray assembly 50 from shifting horizontally during movement of the postage meter 10. The box frame assembly may be shaped and sized to accommodate the metal plate 48 and the waste ink tray assembly 50.

Figure 3:
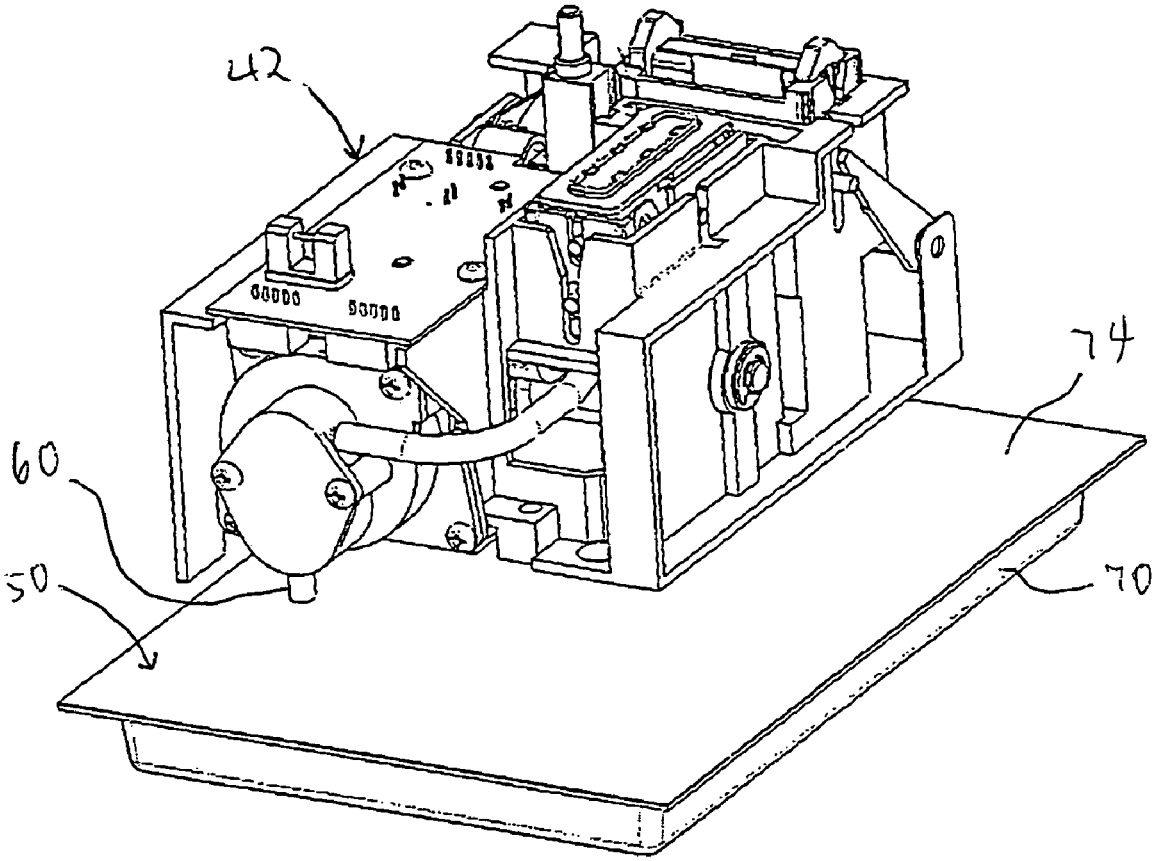
FIG. 3 is an isometric view, taken from the rear, showing in isolation a waste ink purge unit and a waste ink tray assembly provided in accordance with the invention as part of the postage meter of FIGS. 1 and 2.

When the postage meter 10 is in its assembled condition, the waste ink tray assembly 50 is positioned below the purge unit 42 to receive from the purge unit 42 waste ink removed from the print head 40 by the purge unit 42. FIG. 3 is an isometric view, taken from the rear, showing in isolation the purge unit 42 and waste ink tray assembly 50, as the same may be positioned relative to each other when the postage meter 10 is in its assembled condition. The purge unit 42 may be of conventional design, and may include an exhaust port 60 by which waste ink may be expelled from the purge unit 42 into the waste ink tray assembly 50.

Figure 4:
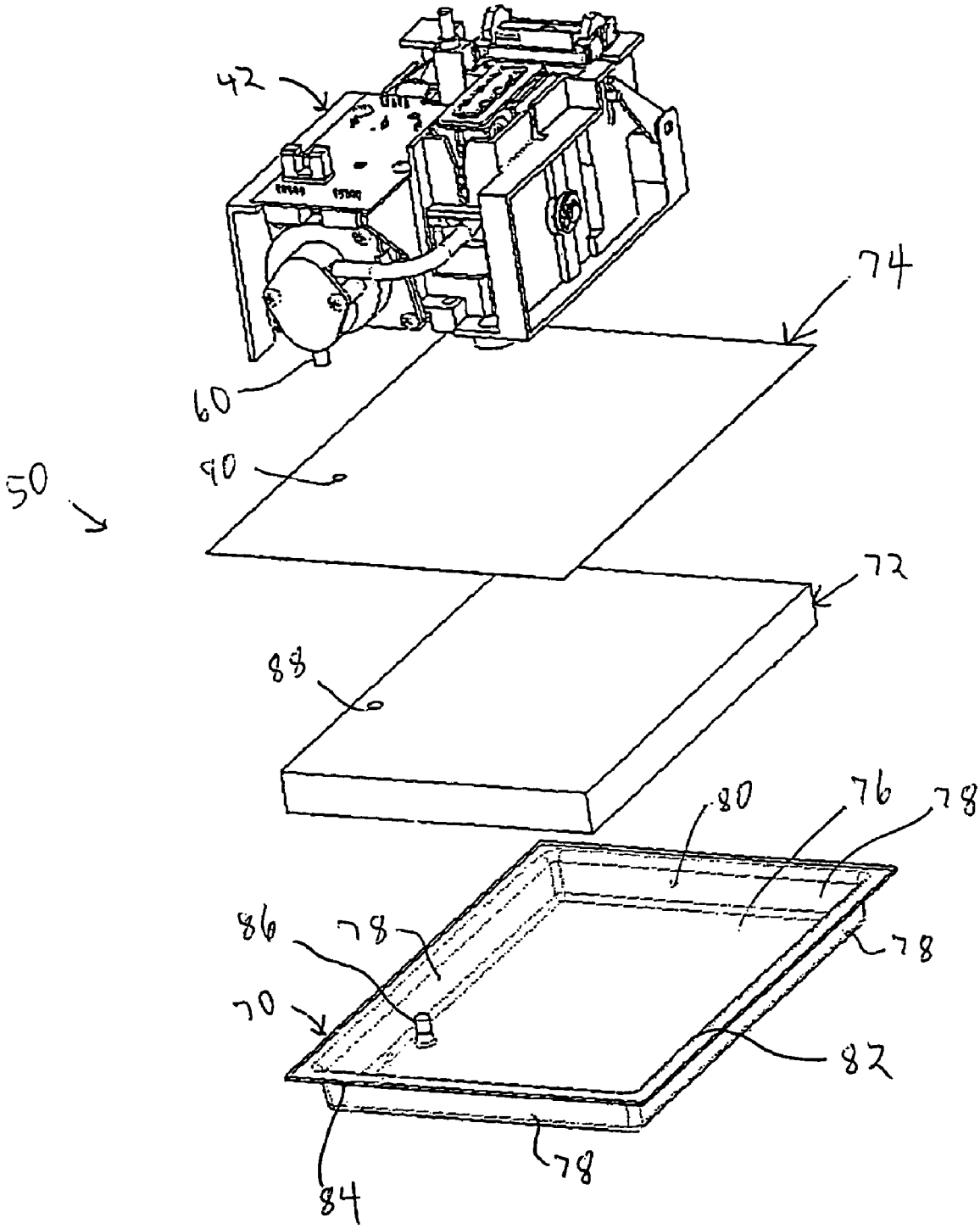
FIG. 4 is a partially exploded view of the postage meter components shown in FIG. 3.

FIG. 4 is similar to FIG. 3, but presenting the waste ink tray assembly 50 in an exploded format. As seen from FIG. 4, the assembly 50 includes an ink tray 70, an absorbent pad 72 and a cover membrane 74.

The ink tray 70 includes a floor 76 and side walls 78, which together define a space in the form of a rectangular prism. The tray 70 is open at its top and thus has an opening 80 defined by the upper edges of the walls 78. The upper edges of the walls 78 may also be considered to form a rim 82. The rim 82 may also be considered to include flanges 84 which extend horizontally outwardly from the upper edges of the walls 78. The tray 70 also includes a cylindrical post 86 which extends upwardly from the floor 76 of the tray 70. The post 86 may have a height that is somewhat less than (say about one-half of) the height of the walls 78.

The absorbent pad 72 may generally be in the shape of a rectangular prism, sized and shaped to fit, perhaps somewhat snugly, within the tray 70. The pad 72 may have a height that is slightly less than the height of the walls 78 of tray 70. The absorbent pad 72 includes a cylindrical channel 88 which extends from top to bottom of the pad 72. The position of the channel 88 in the pad 72 corresponds to the position of the post 86 in the tray 70. The pad may be formed of a material used for ink tray pads in conventional postage meters.

The cover membrane 74 may take the form of a flat rectangular sheet that is shaped and sized to substantially close the opening 80 of the tray 70 and to allow bonding of the membrane 74 to the flanges 84 of the tray 70. The cover membrane 74 may have a circular hole 90 formed therein. The hole 90 may be dimensioned to allow the exhaust port 60 of the purge unit 42 to stretch-fit and seal to the hole 90. The hole 90 may have a position in the cover membrane 74 that corresponds to the position of the channel 88 in the pad 72 and that corresponds to the position of the post 86 in the tray 70.

When the assembly 50 is in the assembled condition, the cover membrane 74 covers the pad 72 and substantially closes the ink tray 70. Also the channel 88 of the pad 72 is positioned in alignment with the hole 90 in the cover membrane 74, and the post 86 of the tray 70 is engaged by channel 88 of the pad 72. The post 86 may thus aid in assembling the ink tray assembly properly so that the hole 90 and the channel 88 are aligned with each other.

Also, when the assembly 50 is in its assembled condition, the periphery of the cover membrane 74 may be bonded to the flanges 84 of the tray 70 so as to seal the rim 82 of the tray 70. The bonding of the cover membrane 74 to the tray flanges may be by heat sealing or ultrasonic sealing, or by suitable adhesive.

The cover membrane 74 may be formed of a material that substantially prevents waste ink from passing through the membrane material, while allowing water vapor to pass through the membrane material. In some embodiments, the membrane may be formed of a suitable polypropylene or polyethylene material. For example, in some embodiments, both the tray 70 and the membrane 74 may be formed of polypropylene to aid in bonding the membrane to the tray. Other types of material may be employed for the membrane 74. Possibly suitable materials may include materials sold under the trademarks Tyvek and Goretex, and materials used for the exterior layer of disposable baby diapers.

In operation of the postage meter 10, mail pieces are presented seriatim to the infeed side 24 of the slot 18 and are transported by the transport unit 22 through the slot 18 past the print head 40, which prints postage indicia on the mail pieces. The mail pieces are then ejected from the outfeed side 26 of the slot 18.

On appropriate occasions, the print head 40 is moved from its print position (not shown) to its purge position (not shown), to allow the purge unit 42 to engage the print head. By action of one or both of the purge unit 42 and the print head 40, excess ink, dried or partially dried ink and/or air bubbles are removed from the print head 40 by the purge unit 42. The resulting waste ink is transported by the purge unit 42 to the waste ink tray assembly 50 and received by the pad 72 and the ink tray 70 via the exhaust port 60 of the purge unit 42 and via the channel 88 in the cover membrane 74.

Because the cover membrane 74 is preferably vapor-permeable, a water component (comprising perhaps 80%) of the waste ink, or a portion of the water component, may be allowed to evaporate from the pad 72 and from the tray 70 so that the occasional infusions of waste ink do not cause the tray to become full over an extended period of time.

Evaporation of the waste ink from the ink tray may be further promoted by heating the tray 70, as described in co-pending, commonly-assigned patent application Ser. No. 0/737,448 (Attorney Docket No. F-731), entitled System For Evaporating Waste Ink In A Postage Meter, which is hereby incorporated herein by reference. For example, in some embodiments, heat generating components of the postage meter, such as a power supply (not shown) or a transport motor (not shown), may be mounted on the chassis 44 (FIG. 2), which may conduct the heat from these components to the metal plate 48 to modestly heat the tray 72 of the assembly 50. In other embodiments, heating of the tray 72 may be omitted, and the metal plate 48 may not be included.

If it happens that the postage meter is handled or shipped after a period of usage, the cover membrane 74 of the waste ink tray assembly 50 may tend to prevent the waste ink from escaping from the waste ink tray assembly during shipment and handling. That is, the membrane 74 may serve as a barrier to substantially prevent waste ink from exiting the tray 70 upon tipping of the tray. Tipping of the tray (including placement of the tray in an upside-down orientation) may occur, for example, because the postage meter 10 is placed on its side or upside down or is otherwise roughly handled during shipment. Even if the postage meter is placed in an upside down orientation, so that waste ink tends to flow out of the tray assembly via the hole 90 in the cover membrane, the purge unit may have a check valve (not separately shown) to prevent the waste ink from escaping.

Because of the presence of the cover membrane, the postage meter may better tolerate shipment and handling, and may be substantially free of befoulment from waste ink. This may reduce or eliminate the need to refurbish the postage meter prior to re-renting and/or may make it unnecessary to scrap the postage meter due to such befoulment. Consequently, the postage meter may have an increased useful life or may have a lower operating cost and/or greater revenue-generating capacity over its total life cycle.

The pad 72 may be useful during shipment or handling of the postage meter to prevent liquid waste ink held within the waste ink tray assembly from functioning as a "liquid hammer" that may cause damage to or rupturing of the cover membrane during shipment or handling. However, in some embodiments, the pad 72 may be omitted, particularly when the tray is relatively small.

Furthermore, the post 86 of the tray 70 may be omitted or replaced with other complementary features of the tray and pad to help assure that the tray assembly is assembled with the channel 88 in alignment with the hole 90.

Figure 5:
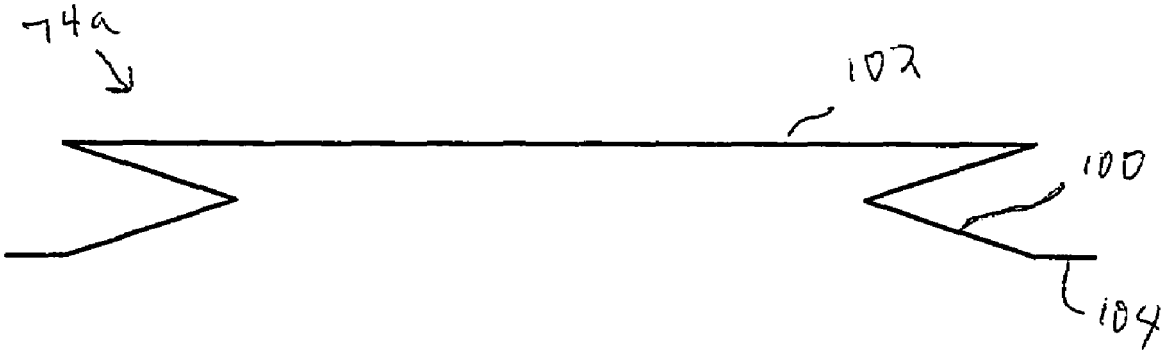
FIG. 5 is a schematic side cross-sectional view of an alternative embodiment of a cover membrane for the waste ink tray assembly of FIGS. 3 and 4.

FIG. 5 is a schematic side cross-sectional view of an alternative embodiment 74*a* of a cover membrane. In this embodiment, the cover membrane 74*a* may include a bellows section 100 that joins an upper, cover section 102 to a lower, attachment section 104. The attachment section 104 extends around the periphery of the membrane 74*a* and may be bonded to the flanges of the ink tray 70. The cover section 102 generally covers the opening of the tray 70. The bellows section 100 may selectively operate to expand the air volume of the ink tray assembly to accommodate air expelled into the ink tray assembly by the purge unit 42. In other embodiments, the cover membrane or the ink tray may include a vent opening (not shown) that is maintained open only when the postage meter is plugged into a power receptacle.

The words "comprise", "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Accordingly, other embodiments are within the scope of the following claims.

What is claimed is:

1. A printer comprising:

a print head;

a purge unit for removing ink from the print head; and an ink tray assembly for receiving ink removed from the print head by the purge unit;

wherein the ink tray assembly includes:

a tray having an opening;

an absorbent pad held in the tray under a cover membrane;

the cover membrane is a vapor permeable membrane sealed across the opening of the tray and formed at least in part as a bellows; and a hole in the cover membrane for sealing to a port of the purge unit.

2. The printer according to claim 1, wherein the absorbent pad has a channel therein positioned in alignment with the hole in the cover membrane.

3. The printer according to claim 2, wherein the tray includes a post extending upwardly from a floor of the tray and engaged by the channel in the absorbent pad.

4. The printer according to claim 1, wherein the cover membrane includes at least one of polypropylene and polyethylene.

5. The printer according to claim 1, wherein the cover membrane is of a material adapted to allow vapor to evaporate through the material and to substantially prevent waste ink from passing through the material.

6. The printer according to claim 5, wherein the material includes at least one of polypropylene and polyethylene.

7. A printer comprising:

a print head;

a purge unit for removing ink from the print head; and an ink tray assembly for receiving ink removed from the print head by the purge unit;

wherein the ink tray assembly includes:

a tray; and barrier means, bonded to a rim of the tray, for substantially preventing waste ink from exiting the tray upon an upside-down orientation of the tray, wherein the barrier means includes a membrane that substantially closes an opening of the tray and wherein the membrane is formed at least in part as a bellows.

8. The printer according to claim 7, wherein the ink tray assembly also includes:

an absorbent pad held in the tray under the membrane.

9. The printer according to claim 8, further comprising a hole in the membrane for sealing to a port of the purge unit.

10. The printer according to claim 9, wherein the absorbent pad has a channel therein positioned in alignment with the hole in the membrane.

11. The printer according to claim 10, wherein the tray includes a post extending upwardly from a floor of the tray and engaged by the channel in the absorbent pad.

12. The printer according to claim 7, wherein the membrane includes at least one of polypropylene and polyethylene.

13. The printer according to claim 7, wherein the barrier means includes a material adapted to allow vapor to evaporate through the material.

14. A waste ink tray assembly for use in a printer, the assembly comprising:

a tray;

an absorbent pad held in the tray; and barrier means, bonded to a rim of the tray, for substantially preventing waste ink from exiting the tray upon an upside-down orientation of the tray, wherein the barrier means includes a membrane that substantially closes an opening of the tray and wherein the membrane is formed at least in part as a bellows.

15. The waste ink tray assembly according to claim 14, further comprising a hole in the membrane for sealing to a port of a waste ink purge unit.

16. The waste ink tray assembly according to claim 15, wherein the absorbent pad has a channel therein positioned in alignment with the hole in the membrane.

17. The waste ink tray assembly according to claim 16, wherein the tray includes a post extending upwardly from a floor of the tray and engaged by the channel in the absorbent pad.

18. The waste ink tray assembly according to claim 14, wherein the membrane includes at least one of polypropylene and polyethylene.

19. The waste ink tray assembly according to claim 14, wherein the barrier means includes a material adapted to allow vapor to evaporate through the material.

* * * * *